US011696635B2

(12) United States Patent
Yoshiwara

(10) Patent No.: US 11,696,635 B2
(45) Date of Patent: Jul. 11, 2023

(54) COSMETIC CONTAINER WITH APPLICATION MEMBER

(71) Applicant: TOKIWA CORPORATION, Nakatsugawa (JP)

(72) Inventor: Shinichi Yoshiwara, Kawaguchi (JP)

(73) Assignee: TOKIWA CORPORATION, Nakatsugawa (JP)

( * ) Notice: Subject to any disclaimer, the term of this patent is extended or adjusted under 35 U.S.C. 154(b) by 0 days.

(21) Appl. No.: 17/725,011

(22) Filed: Apr. 20, 2022

(65) Prior Publication Data

US 2022/0338606 A1 Oct. 27, 2022

(30) Foreign Application Priority Data

Apr. 21, 2021 (JP) ..... JP2021-071737

(51) Int. Cl.
*A45D 34/00* (2006.01)
*A46B 11/00* (2006.01)

(52) U.S. Cl.
CPC ..... *A46B 11/0089* (2013.01); *A46B 11/0065* (2013.01); *A46B 11/0086* (2013.01); *A45D 2034/005* (2013.01); *A45D 2200/10* (2013.01); *A46B 2200/1046* (2013.01)

(58) Field of Classification Search
CPC ..... A45D 34/04; A45D 2034/005; A45D 2200/10; A46B 11/0065; A46B 11/0089; A46B 2200/1046; A46B 11/00; A46B 11/001; A46B 11/0013; A46B 11/0072; A46B 11/0079; A46B 11/0086
See application file for complete search history.

(56) References Cited

U.S. PATENT DOCUMENTS 7,775,737 B2 * 8/2010 Deans ..... A45D 33/02 401/281
7,794,168 B2 * 9/2010 Chang ..... A46B 17/04 401/269
8,651,763 B2 * 2/2014 Byun ..... A46B 7/023 401/268

FOREIGN PATENT DOCUMENTS

EP 1125519 A1 1/2000
JP 2001-224437 A 8/2001

* cited by examiner

*Primary Examiner* — David J Walczak
(74) *Attorney, Agent, or Firm* — Procopio, Cory, Hargreaves & Savitch LLP

(57) ABSTRACT

A cosmetic container with an application member includes a cylindrical barrel, a core, a bottle that is configured to accommodate cosmetic and has an opening, a sleeve, and a joint that has an opening portion and a closed portion. The sleeve is configured to expose the application member or cover an outer circumference of the application member by a sliding operation of the sleeve. When the sleeve slides for exposing the application member, the opening portion overlaps with the opening so that the cosmetic passes through the opening portion and the opening. When the sleeve slides for covering the outer circumference of the application member, the closed portion overlaps with the opening to prevent the cosmetic from passing through between the joint and the bottle.

7 Claims, 19 Drawing Sheets

COSMETIC CONTAINER WITH APPLICATION MEMBER

CROSS REFERENCE TO RELATED APPLICATIONS

This application is based on Japanese Patent Applications No. 2021-071737 filed on Apr. 21, 2021, the entire contents of which are incorporated herein by reference.

BACKGROUND

The present disclosure relates to a cosmetic container with an application member that applies a cosmetic accommodated inside.

JP-A-2001-224437 is known as disclosing a cosmetic container with an application member in the related art. The cosmetic container with an application member disclosed in JP-A-2001-224437 is provided with an application member (soft hair) that applies a cosmetic at a tip end of the container, and at the time of use, a cap (protective cap) that covers the application member is detached, and the cosmetic (powder) accommodated in the container is applicable to a portion to be coated (skin) by the application member. The cosmetic container with an application member has an advantage of being easy to carry and easy to use.

However, in the cosmetic container with an application member disclosed in JP-A-2001-224437, there is a matter that, when the cosmetic container with an application member is being carried or when the cosmetic container with an application member is placed with a tip end of the application member facing downward, the cosmetic is unintentionally moved to the application member, and the cosmetic is excessively held by the application member.

An object of the present disclosure is to provide a cosmetic container with an application member that prevents a cosmetic from leaking (moving) to the application member, when not intended by a user.

SUMMARY

According to an aspect of the present disclosure, a cosmetic container with an application member includes a cylindrical barrel as a container body, the application member configured to apply a cosmetic to a given portion, a core that holds the application member, a bottle that is configured to accommodate the cosmetic, has an opening that allows the cosmetic to pass through at a tip end side of the bottle, and is attached to the barrel, a sleeve that is configured to slide in an axial direction of the barrel relative to the barrel, and a joint that is configured to engage with the bottle so as to be immovable in the axial direction relative to the bottle and rotatable relative to the bottle around an axis in conjunction with a sliding operation of the sleeve relative to the barrel and has an opening portion and a closed portion on a tip end side of the joint. The joint is attached to the core at a front side of the joint than the opening portion and the closed portion in the axial direction. The sleeve is configured to expose the application member or cover an outer circumference of the application member by the sliding operation of the sleeve. When the sleeve slides in a direction of exposing the application member, the opening portion of the joint overlaps with the opening of the bottle in the axial direction so that the cosmetic passes through the opening portion and the opening. When the sleeve slides in a direction of covering the outer circumference of the application member, the closed portion of the joint overlaps with the opening of the bottle to prevent the cosmetic from passing through between the joint and the bottle.

According to such a cosmetic container with an application member, the sleeve is slidable in the axial direction relative to the ban-el as the container body, and the bottle that accommodates the cosmetic and has the opening that allows the cosmetic to pass through at the tip end side is attached to the barrel. The joint having the opening portion and the closed portion on the tip end side engages with the bottle so as to be immovable in the axial direction and rotatable relative to the bottle around the axis. The core that holds the application member is attached to the front side of the opening portion and the closed portion of the joint in the axial direction, and the sleeve is configured to expose the application member or cover the outer circumference of the application member by the sliding operation of the sleeve. When the cosmetic container with an application member is not used, for example, when the cosmetic container with an application member is carried, the sleeve slides relative to the barrel and is pulled out so as to cover the outer circumference of the application member. In this state, the closed portion of the joint overlaps with the opening of the bottle, and the cosmetic in the bottle cannot pass through the opening. On the other hand, in order to use the cosmetic container with the application member, when the sleeve slides relative to the barrel and is pushed into the barrel so as to expose the application member, the joint rotates relative to the bottle, the opening portion of the joint overlaps with the opening of the bottle, the cosmetic in the bottle passes through the opening and the opening portion toward the application member, and is applied for coating by the exposed application member. That is, it is possible to prevent the cosmetic from leaking (moving) to the application member, when not intended by a user.

Here, since the adjustment portion that adjusts the amount of the cosmetic is provided between the application member and at least one of the opening portion or the closed portion of the joint, excessive discharge of the cosmetic to the application member is prevented, and an appropriate amount of the cosmetic is applied.

When the bottle is detachably attached to the barrel, for example, when the cosmetic is used up, the bottle is easily replaced with a new bottle accommodating the cosmetic.

When the core is detachably attached to the joint, for example, when the application member is deteriorated, the core is easily replaced with a new core holding a new application member.

As described above, according to the present disclosure, it is possible to provide the cosmetic container with the application member that prevents the cosmetic from leaking to the application member, when not intended by the user.

DESCRIPTION OF EMBODIMENTS

Figure 1:
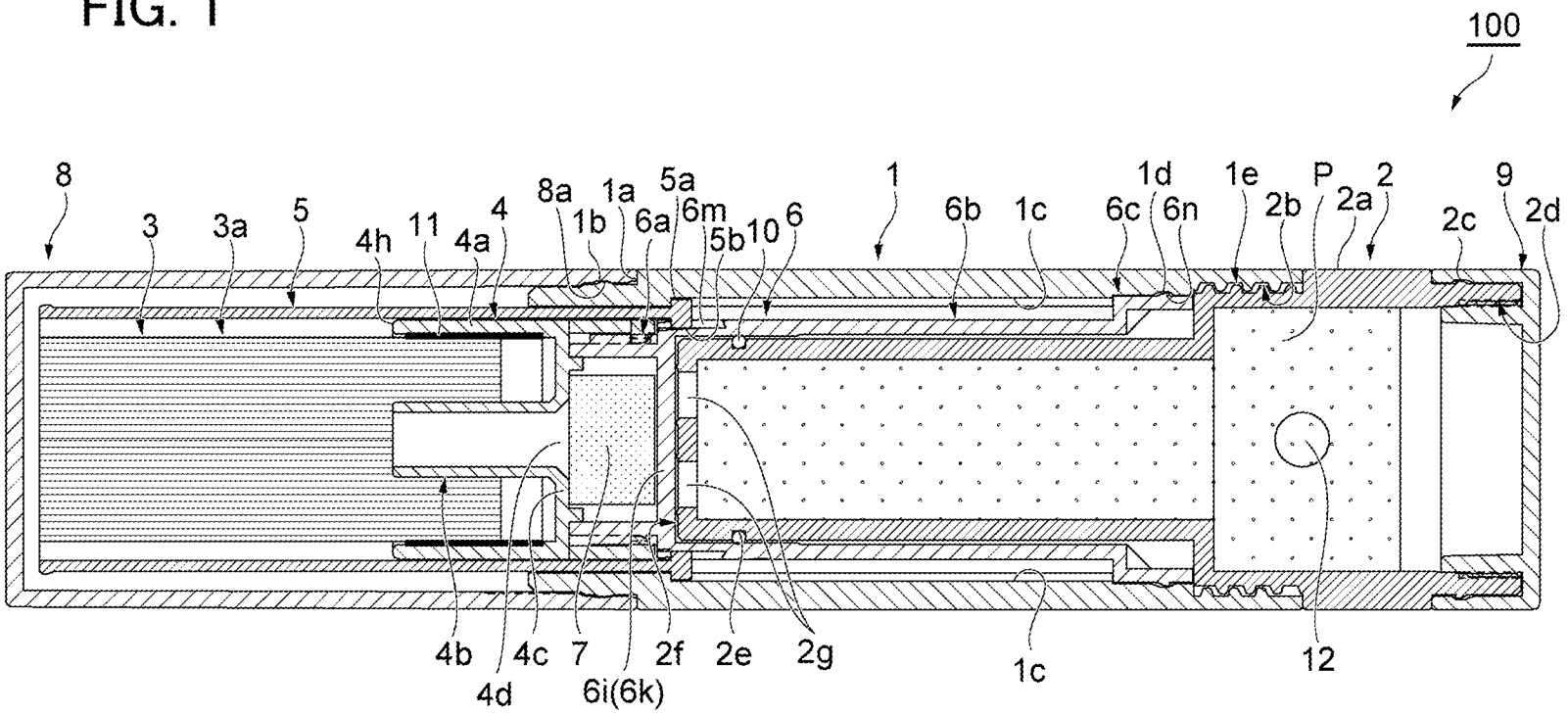
FIG. 1 is a longitudinal cross-sectional view showing a cosmetic container with an application member according to an embodiment of the present disclosure, and is a longitudinal cross-sectional view showing an unused state where a sleeve slides relative to a barrel and is pulled out of the barrel so as to cover an outer circumference of the application member, and a cap is attached.
Figure 2:
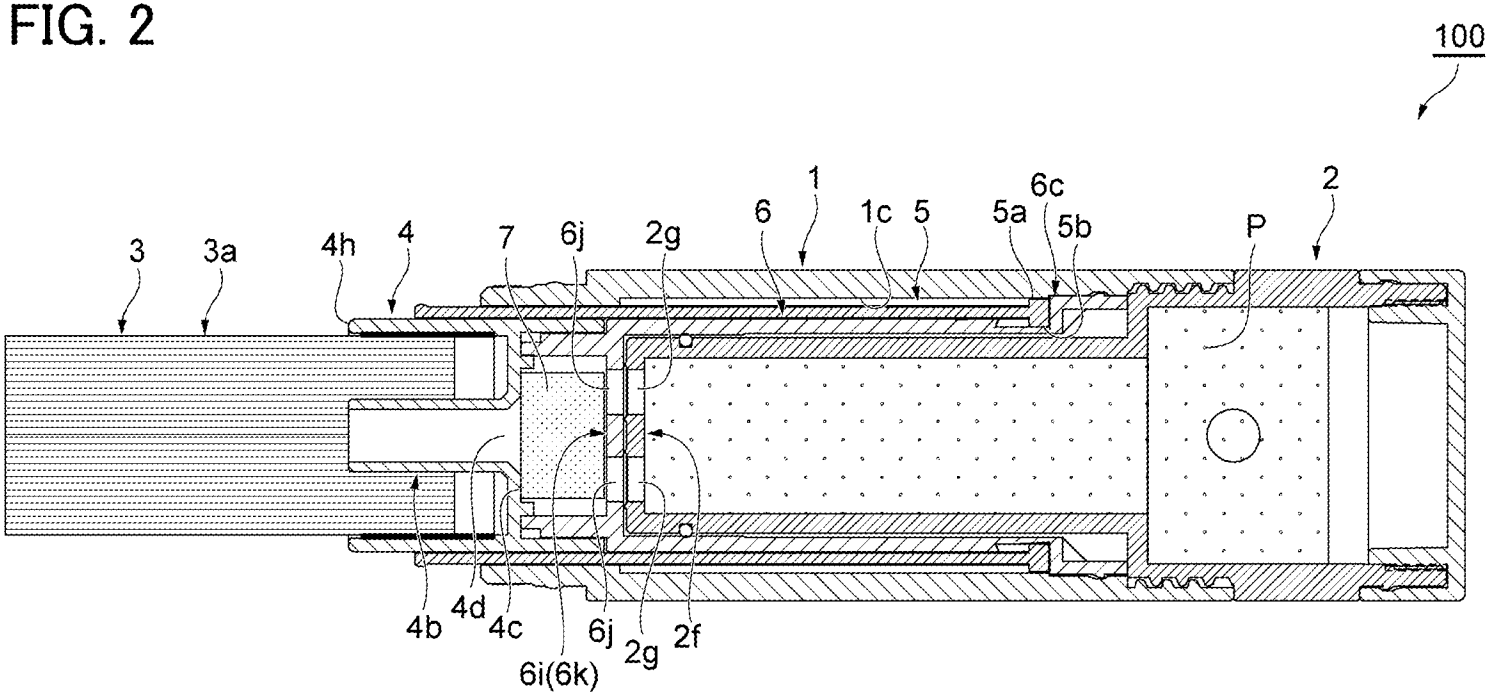
FIG. 2 is a longitudinal cross-sectional view showing a use state where the cap is detached from the state of FIG. 1 and the sleeve slides relative to the barrel and is pushed into the barrel so as to expose the application member.
Figure 3:
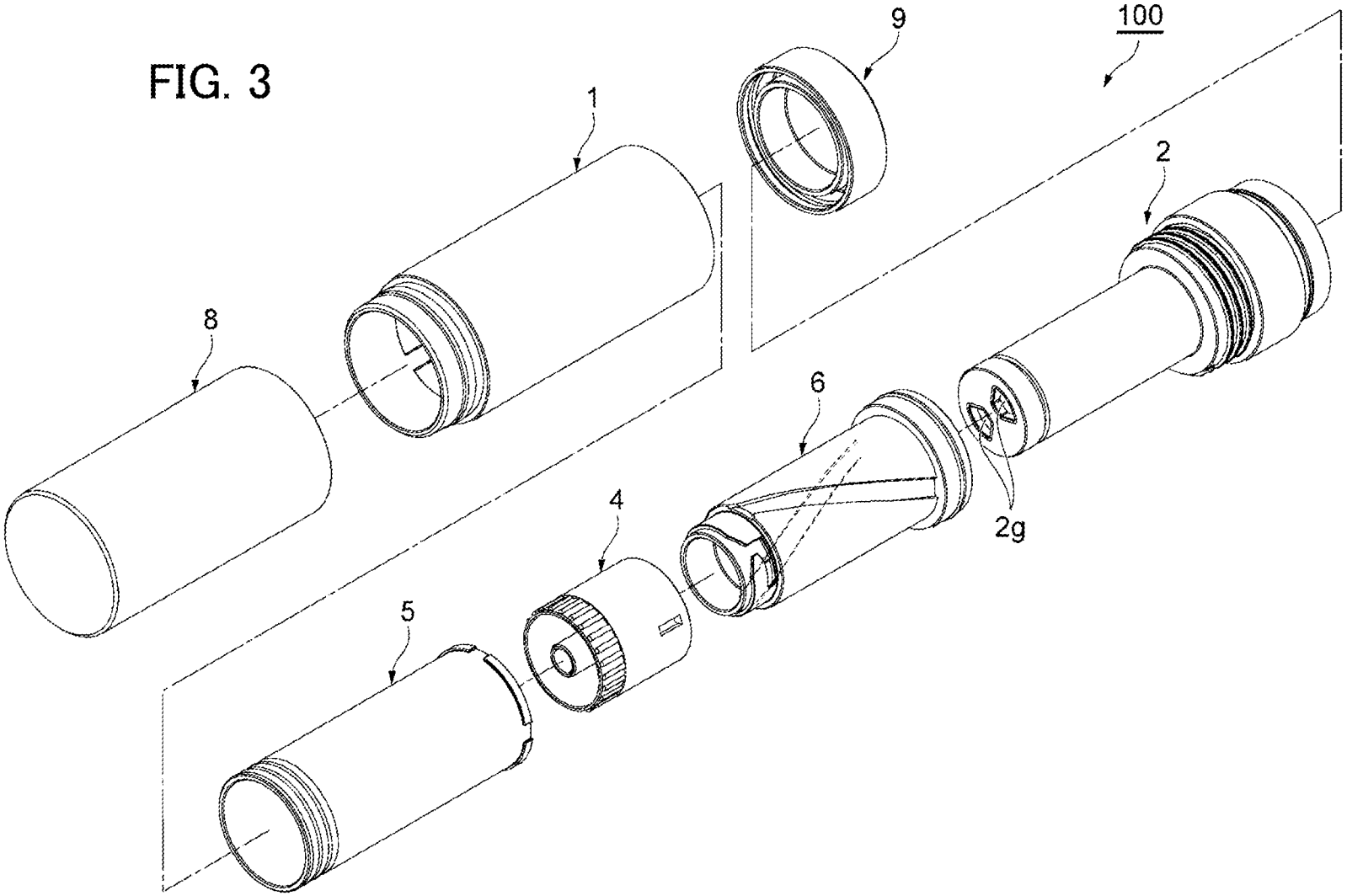
FIG. 3 is an exploded perspective view of the cosmetic container with an application member shown in FIG. 1, excluding the application member and an adjustment portion.
Figure 4:
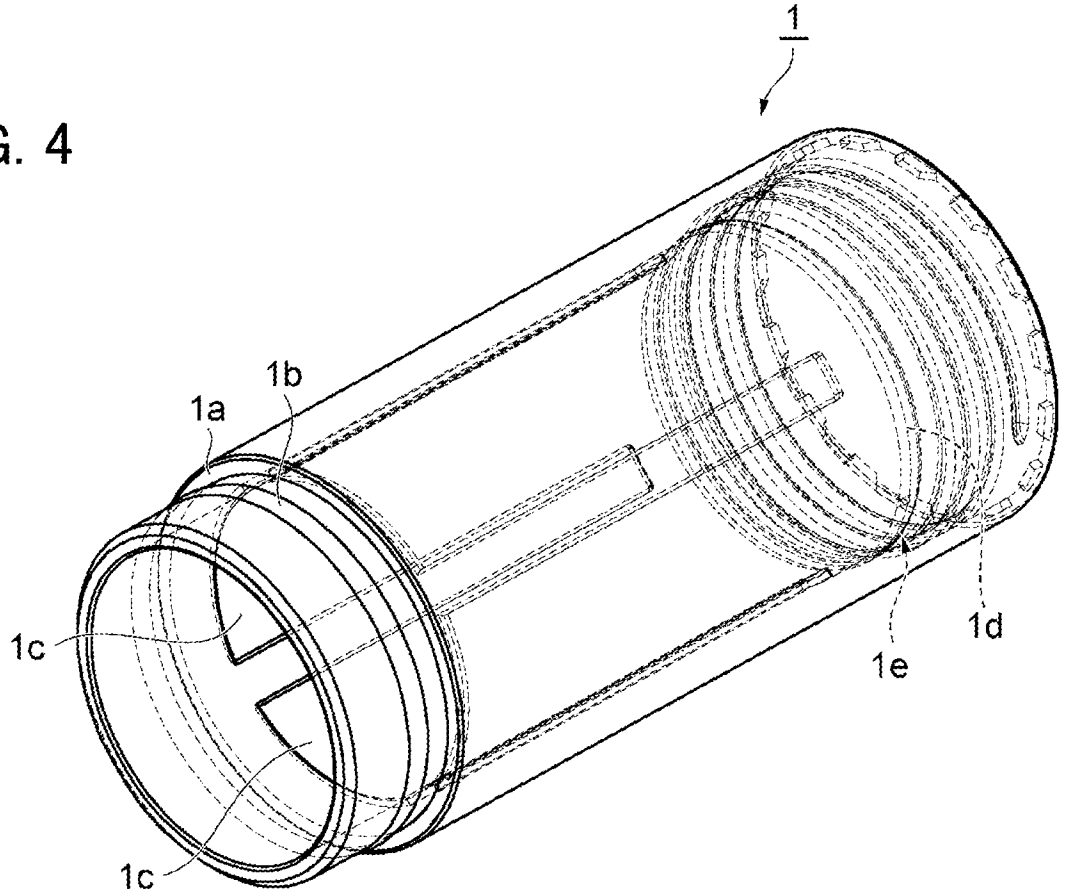
FIG. 4 is a perspective view showing the barrel in FIG. 3.
Figure 5:
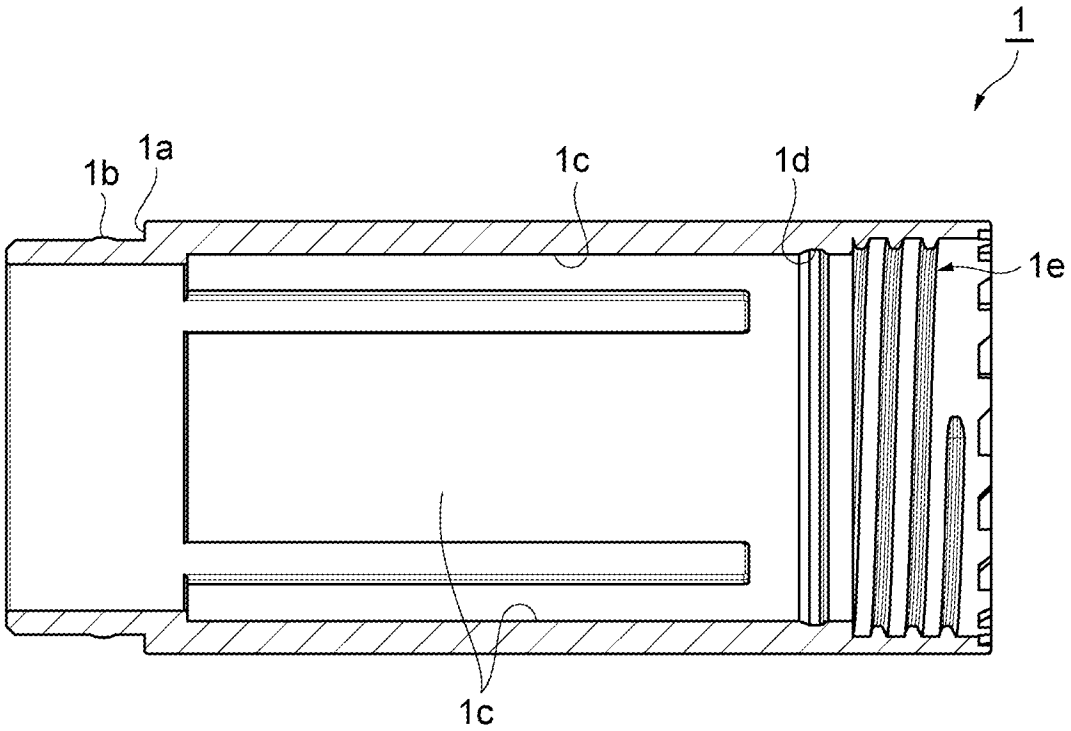
FIG. 5 is a longitudinal cross-sectional view of the barrel shown in FIG. 4.
Figure 6:
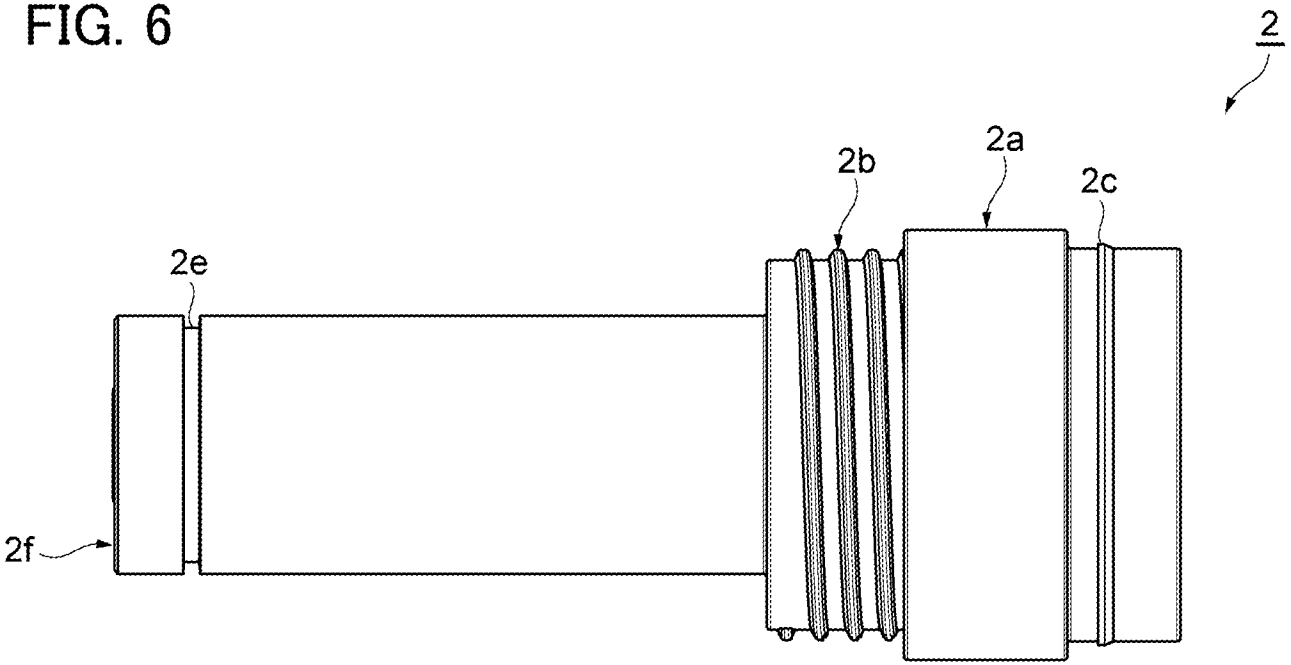
FIG. 6 is a side view showing a bottle in FIG. 3.
Figure 7:
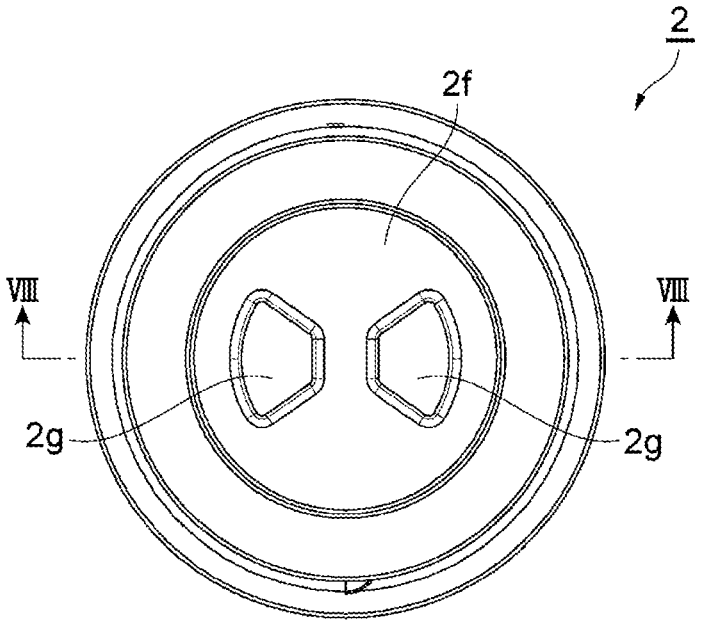
FIG. 7 is a left side view of the bottle shown in FIG. 6.
Figure 8:
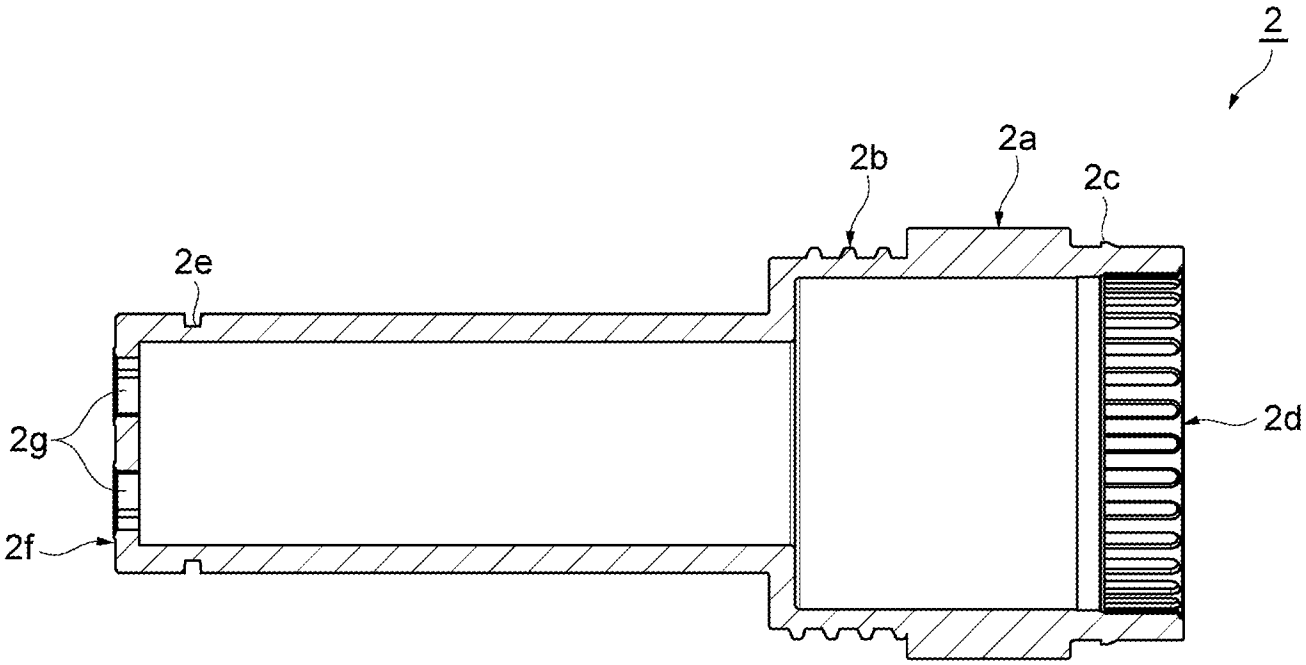
FIG. 8 is a cross-sectional view taken along a line VIII-VIII in FIG. 7.
Figure 13:
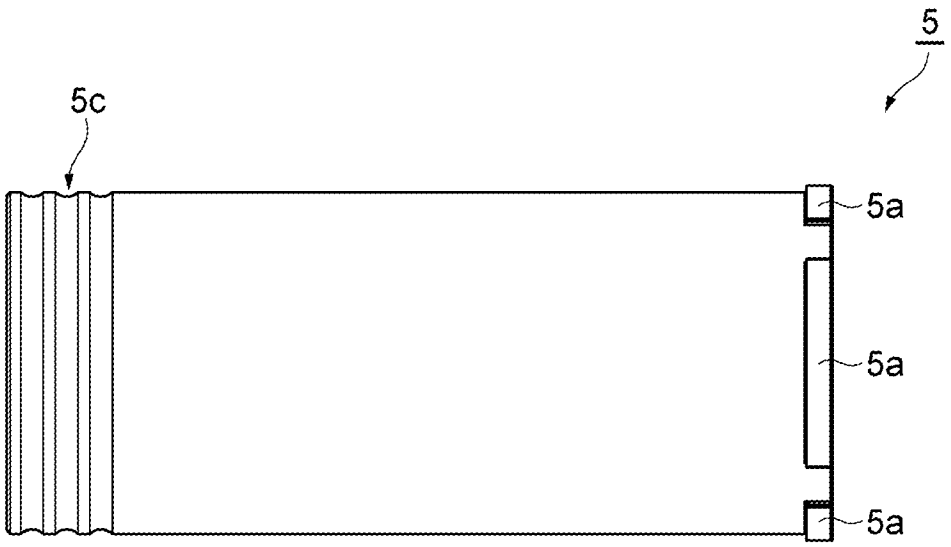
FIG. 13 is a side view showing the sleeve in FIG. 3.
Figure 14:
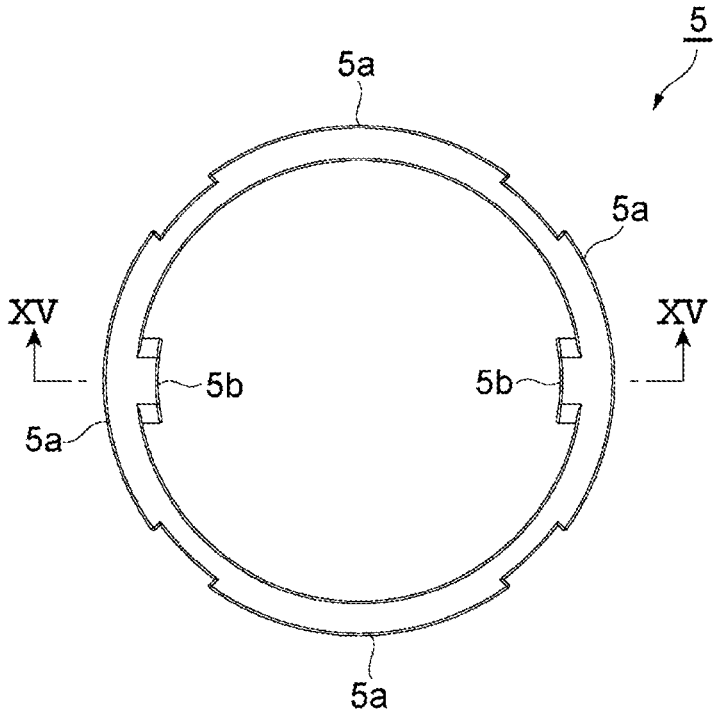
FIG. 14 is a right side view of the sleeve shown in FIG. 13.
Figure 15:
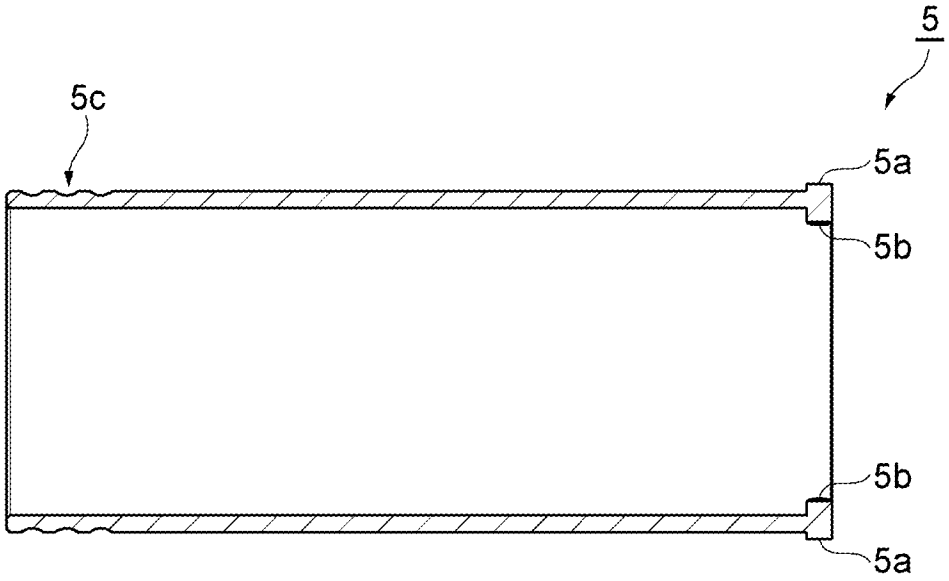
FIG. 15 is a cross-sectional view taken along a line XV-XV in FIG. 14.
Figure 16:
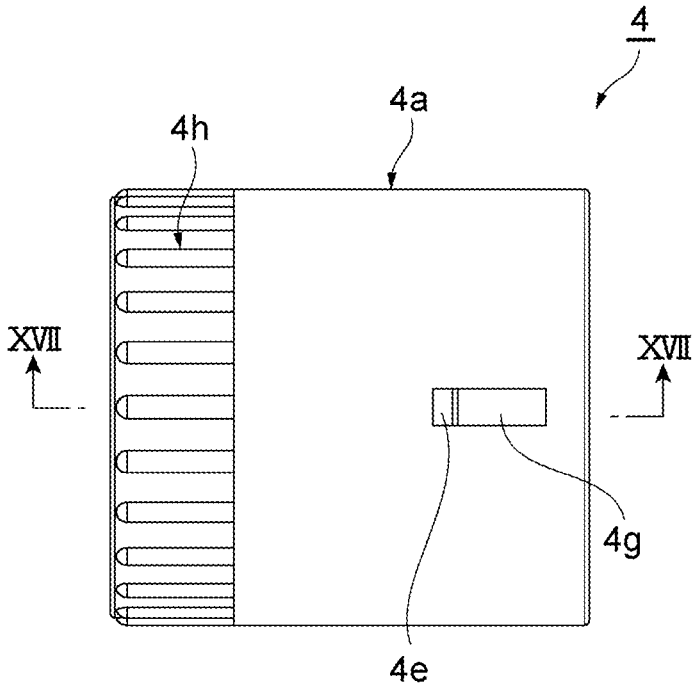
FIG. 16 is a side view showing a core in FIG. 3.
Figure 17:
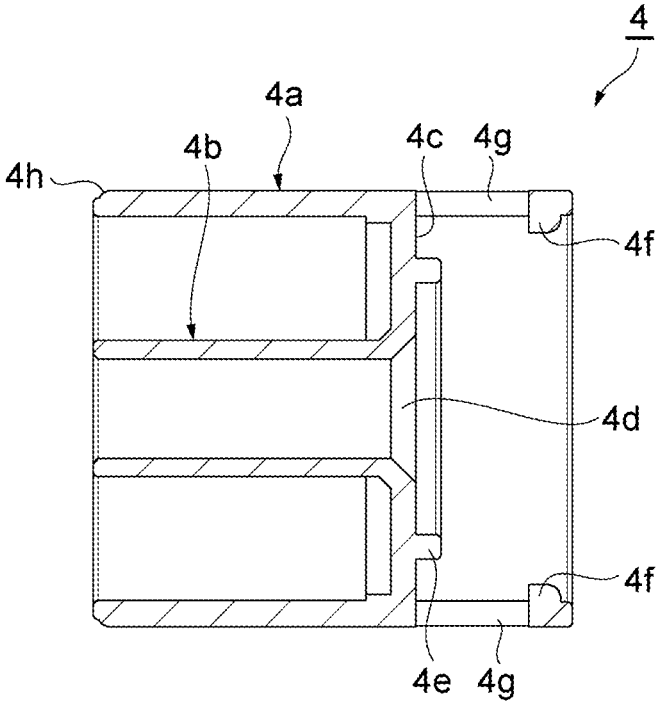
FIG. 17 is a cross-sectional view taken along a line XVII-XVII in FIG. 16.
Figure 18:
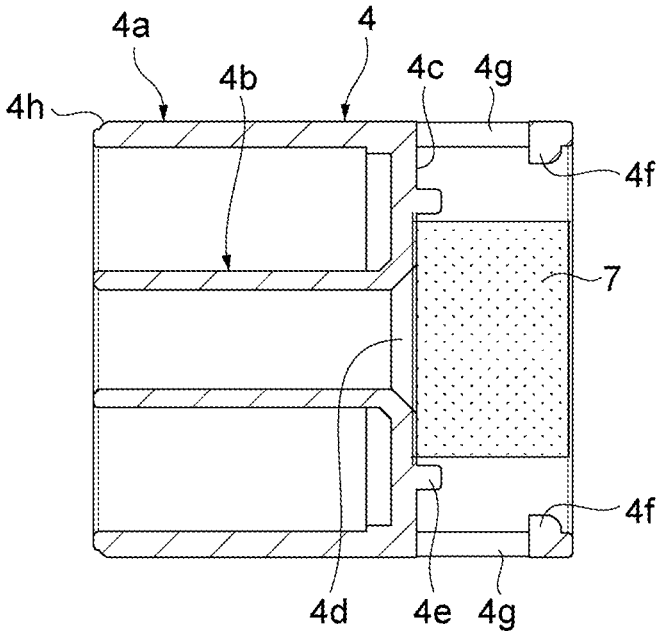
FIG. 18 is a cross-sectional view in which the adjustment portion is attached to the core shown in FIG. 17.
Figure 19:
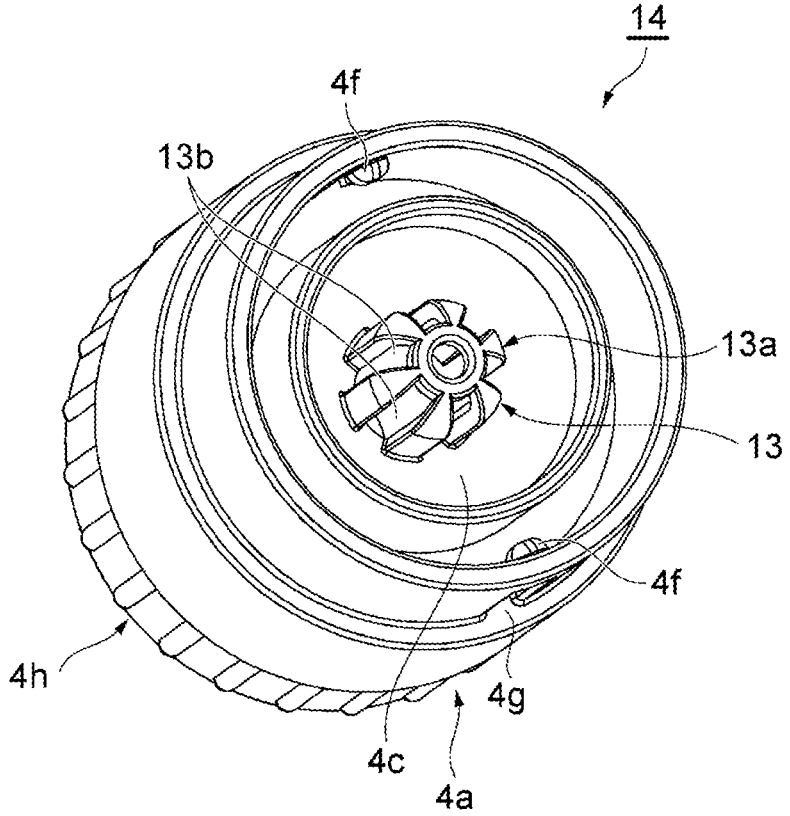
FIG. 19 is a perspective view of a core including another adjustment portion as viewed from a rear side.

Hereinafter, a preferred embodiment of a cosmetic container with an application member according to the present disclosure will be described with reference to FIGS. 1 to 19. FIG. 1 is a longitudinal cross-sectional view showing the cosmetic container with the application member according to an embodiment of the present disclosure, and is a longitudinal cross-sectional view showing an unused state where a sleeve slides relative to a barrel and is pulled out of the barrel so as to cover an outer circumference of the application member, and a cap is attached. FIG. 2 is a longitudinal cross-sectional view showing a use state where the cap is detached from the state of FIG. 1 and the sleeve slides relative to the barrel and is pushed into the barrel so as to expose the application member. FIG. 3 is an exploded perspective view of the cosmetic container with an application member shown in FIG. 1, excluding the application member and an adjustment portion. FIGS. 4 and 5 are views showing the barrel. FIGS. 6 to 8 are views showing the bottle. FIGS. 9 to 12 are views showing a joint. FIGS. 13 to 15 are views showing the sleeve. FIGS. 16 and 17 are views showing a core. FIG. 18 is a cross-sectional view in which the adjustment portion is attached to the core. FIG. 19 is a perspective view of a core including another adjustment portion as viewed from a rear side.

The cosmetic container with an application member according to the present embodiment applies, for example, powder as a powder cosmetic to a skin or the like as a portion to be coated with the application member.

As shown in FIGS. 1 and 3, the cosmetic container with an application member 100 includes: a barrel 1 as a container body; a bottle (here, also referred to as a powder barrel) 2 that is attached to a rear end side of the barrel 1 and is positioned in the barrel 1 and accommodates powder P inside; a brush (hair brush) 3 as the application member that applies the powder P to the portion to be coated; a core 4 that holds a rear portion of the brush 3; a sleeve 5 (also see FIG. 2) that is disposed in the barrel 1 and is slidable in an axial direction; a joint 6 (also see FIG. 2) in which the core 4 is attached to a tip end side and which is disposed inside the sleeve 5, rotates relative to the bottle 2 in conjunction with a sliding operation of the sleeve 5, and has a valve function that allows or disables the powder P in the bottle 2 to flow toward the brush 3; an adjustment portion 7 that is disposed between the joint 6 and the core 4 and adjusts an amount of the powder P moving from the joint 6 to the brush 3; a cap 8 as a lid body that is attached to and detached from a tip end side of the barrel 1; and a tail plug 9 that covers a rear end portion of the bottle 2.

The barrel 1 is made of, for example, acrylonitrile butadiene styrene (ABS) or the like, and is formed in a cylindrical shape as shown in FIGS. 3 to 5. A tip end portion of the barrel 1 is reduced in diameter via a step 1*a*, and an outer circumferential surface of the tip end portion is provided with a convex portion 1*b* in an annular shape that engages with the cap 8 in the axial direction.

An inner circumferential surface of the barrel 1 is provided with concave portions 1*c* that have a large width in a circumferential direction and are recessed (enlarged in diameter) in a radial direction and opened rearward from a position slightly rearward of the step 1*a* in the axial direction, to allow the sleeve 5 to slide in the axial direction. The concave portions 1*c* are disposed at positions equidistant from each other by 90° around an axis. A tip end surface of the concave portion 1*c* of the barrel 1 functions as an advance limit of the sleeve 5 against which a convex portion 5*a*, described below, of the sleeve 5 abuts. A female screw 1*e* that attaches the bottle 2 by screwing is spirally provided on an inner circumferential surface of a rear end portion of the barrel 1, and a concave portion 1*d* that attaches the joint 6 is provided in an annular shape on a front side of the female screw 1*e*.

The bottle 2 is made of polyethylene terephthalate (PET) or the like, for example, and is formed in a stepped capped cylindrical shape as shown in FIGS. 3 and 6 to 8. An inside of the bottle 2 accommodates the powder P.

A rear portion of the bottle 2 is an enlarged diameter portion, and an intermediate portion in the axial direction of the enlarged diameter portion is a large diameter cylindrical portion 2*a*. A diameter of the enlarged diameter portion of the bottle 2 is reduced on a front side of the large diameter cylindrical portion 2*a*, and a male screw 2*b* that is screwed with the female screw 1*e* of the barrel 1 is spirally provided on an outer circumferential surface of the enlarged diameter portion of the bottle 2. The diameter of the enlarged diameter portion of the bottle 2 is reduced on a rear side of the large diameter cylindrical portion 2*a*, and a convex portion 2*c* is provided in an annular shape on the outer circumferential surface of the enlarged diameter portion of the bottle 2, and a knurl 2*d* in which a large number concave and convex portions are disposed side by side along the circumferential direction is provided on an inner circumferential surface on the rear side of the large diameter cylindrical portion 2*a*. The convex portion 2*c* and the knurl 2*d* press-fit the tail plug 9. An O-ring groove 2*e* that attaches an O-ring 10 (see FIG. 1) is provided in an annular shape on an outer circumferential surface of a tip end portion of the bottle 2. The O-ring 10 is for airtightness between the bottle 2 and the joint 6.

A capped portion 2*f* of the bottle 2 has a pair of openings 2*g* that face each other, have a fan face shape of a fan as viewed in the axial direction, and communicate an inside and outside of the bottle 2. The opening 2*g* allows the powder P to pass through.

The tail plug 9 is made of, for example, polypropylene (PP) or the like, and is formed in a bottomed cylindrical shape and a double cylindrical shape as shown in FIGS. 1 and 3.

As shown in FIG. 1, the tail plug 9 is pushed into the rear end portion of the bottle 2, an inner cylinder of the tail plug 9 is internally inserted into the knurl 2*d* at the rear end portion of the bottle 2 and fitted, and an outer cylinder of the tail plug 9 is externally inserted into the convex portion 2*c* at the rear end portion of the bottle 2 and engages with the convex portion 2*c* in the axial direction, so that the tail plug 9 is press-fitted into the bottle 2. Thus, the inside of the bottle 2 having the rear end portion closed by the tail plug 9 serves as an accommodation space for accommodating the powder P. A stirring ball 12 that stirs the powder P is accommodated in the bottle 2.

The brush 3 is made of, for example, polybutylene terephthalate (PBT) or the like, and applies the powder P to the portion to be coated. As shown in FIG. 1, the brush 3 is formed by bundling a large number of hairs (fibers) 3*a*, and an outer shape of the brush 3 is substantially columnar. The rear portion of the brush 3 is internally inserted into a cylindrical brush holding portion 11 made of, for example, aluminum, and is fixed by, for example, adhesion, welding, or the like.

The core 4 is made of, for example, ABS or the like and holds the brush 3. As shown in FIGS. 3, 16, and 17, the core 4 is formed in a double cylindrical shape having an outer cylinder 4*a* and an inner cylinder 4*b*. A front half portion of the outer cylinder 4*a* of the core 4 allows the brush holding portion 11 to be pushed in and holds the brush holding portion 11 to which the rear portion of the brush 3 is fixed.

The inner cylinder 4*b* is disposed only in a substantially front half portion of the core 4, and an inner circumferential surface of the outer cylinder 4*a* substantially at a center in the axial direction and a rear end portion of the inner cylinder 4*b* are connected by a disk-shaped partition portion 4*c*. The partition portion 4*c* is provided with a through hole 4*d* that communicates with an inside of the inner cylinder 4*b* and allows the powder P to pass through. The inner cylinder 4*b* corresponds to an axial center position of a rear end portion of the brush 3 and is pushed into the rear end portion of the brush 3. At a position surrounding the through hole 4*d* on a rear end surface of the partition portion 4*c* of the core 4, a cylindrical portion 4*e* that protrudes rearward in a short length attaches the adjustment portion 7.

On an inner circumferential surface of a rear end portion of the outer cylinder 4*a* of the core 4, a pair of convex portions 4*f* facing each other detachably attaches the core 4 to the joint 6. Communication holes 4*g* that allow an inside and outside of the outer cylinder 4*a* to communicate with each other are provided on front sides of the convex portion 4*f* of the outer cylinder 4*a* over the partition portion 4*c*. The communication holes 4*g* are provided so that a mold that prevents a core pin from being forcibly pulled out rearward enters the communication holes 4*g* when the convex portion 4*f* is formed by mold molding.

In addition, a knurl 4*h* in which a large number of concave and convex portions are disposed side by side along the circumferential direction is provided on an outer circumferential surface of a tip end portion of the outer cylinder 4*a* of the core 4. The knurl 4*h* is provided as a slip stopper that allows the core 4 to be easily pinched when the core 4 is attached to or detached from the joint 6.

Then, as shown in FIG. 1, as a result of the brush holding portion 11 being internally inserted into the outer cylinder 4*a* and fixed, and the inner cylinder 4*b* being pushed into the axial center position of the rear end portion of the brush 3, when the brush 3 is exposed from the sleeve 5 (see FIG. 2), the brush 3 has a shape that gradually and slightly swells in the radial direction toward a tip end.

The sleeve 5 is made of, for example, PET or the like, and is formed in a cylindrical shape as shown in FIGS. 3 and 13 to 15. The sleeve 5 slides between an advance position (see FIG. 1) where the sleeve 5 covers an outer circumference of the brush 3 and a retreat position (see FIG. 2) where the brush 3 is exposed.

On an outer circumferential surface of a rear end portion of the sleeve 5, convex portions 5*a* that enters the concave portion 1*c* of the barrel 1, engages with the concave portion 1*c* in a rotation direction, and slides in the concave portion 1*c* are disposed at positions equidistant from each other by 90° around the axis. On an inner circumferential surface of the rear end portion of the sleeve 5, a pair of protrusions 5*b* that face each other and guide the joint 6 is provided so as to be rotatable relative to the joint 6 around the axis. In addition, on an outer circumferential surface of a tip end portion of the sleeve 5, a concave and convex portion 5*c* having an annular shape and disposed along the axial direction is provided as the slip stopper that allows the sleeve 5 to be easily pinched when the sleeve 5 is slid.

Then, as shown in FIG. 1, the sleeve 5 is internally inserted into the barrel 1 from a tip end side of the sleeve 5, and the convex portion 5*a* of the sleeve 5 enters the concave portion 1*c* of the barrel 1, so that the sleeve 5 is slidable in the axial direction relative to the barrel 1 and is not rotatable relative to the barrel 1 around the axis.

The joint 6 is made of polyoxymethylene (POM) or the like, for example, and is formed in a stepped cylindrical shape as shown in FIGS. 3 and 9 to 12. The joint 6 rotates relative to the bottle 2 in conjunction with sliding of the sleeve 5.

In the joint 6, a tip end portion 6*a*, an intermediate portion 6*b*, and a rear end portion 6*c* are provided in sequence in this order from a tip end side to a rear end side. Inner and outer diameters of the intermediate portion 6*b* are larger than inner and outer diameters of the tip end portion 6*a*, and inner and outer diameters of the rear end portion 6*c* are larger than the inner and outer diameters of the intermediate portion 6*b*.

An outer circumferential surface of a tip end 6*d* of the tip end portion 6*a* has a small diameter, an outer circumferential surface of an engagement cylinder 6*e* continuing from the tip end 6*d* having the small diameter to the intermediate portion 6*b* has a diameter larger than the tip end 6*d* and smaller than the intermediate portion 6*b*, and a pair of concave grooves 6*f* that face each other and are flush with the outer circumferential surface of the tip end 6*d* are provided on the outer circumferential surface of the engagement cylinder 6*e* so that the convex portion 4*f* of the outer cylinder 4*a* of the core 4 enters and moves.

The concave groove 6*f* is provided along the outer circumferential surface so as to form a substantially L shape in a side view, and one side 6*g* forming the L shape extends along the axial direction and communicates with the outer circumferential surface of the tip end 6*d*, and the other side 6*h* forming the L shape extends along the circumferential direction.

An inside of the tip end portion 6*a* and an inside of the intermediate portion 6*b* are partitioned by a partition portion 6*i*. The partition portion 6*i* has substantially the same shape as the opening 2*g* of the capped portion 2*f* of the bottle 2, that is, has the fan face shape of the fan as viewed in the axial direction, and is provided with a pair of opening portions 6*j* that face each other and communicate the inside of the tip end portion 6*a* and the inside of the intermediate portion 6*b* to allow the powder P to pass through. A portion other than the opening portion 6*j* of the partition portion 6*i* is a closed portion 6*k*. The opening portion 6*j* and the closed portion 6*k* exert a valve function that allows or disables the powder P in the bottle 2 to flow toward the brush 3.

A pair of guide grooves 6*m* that face each other and allow the protrusions 5*b* of the sleeve 5 to enter and guide the protrusions 5*b* are provided on an outer circumferential surface of the intermediate portion 6*b*. The guide groove 6*m* extends spirally in the axial direction, straddles a quarter arc as viewed in the axial direction, and has a shape that is point-symmetric centered on an axial center of the intermediate portion 6*b*. A tip end of the guide groove 6*m* is opened forward, and a rear end of the guide groove 6*m* extends to a tip end surface of the rear end portion 6*c*.

On the outer circumferential surface of the rear end portion 6*c*, a convex portion 6*n* that engages with the concave portion 1*d* of the barrel 1 in the axial direction is provided in an annular shape. The tip end surface of the rear end portion 6*c* functions as a retreat limit of the sleeve 5 against which the convex portion 5*a* of the sleeve 5 abuts.

Then, as shown in FIG. 1, the joint 6 is internally inserted into the barrel 1 from the tip end side of the joint 6, and the convex portion 6*n* of the joint 6 engages with the concave portion 1*d* of the barrel 1 in the axial direction, so that the joint 6 is immovable in the axial direction relative to the barrel 1 and is rotatable relative to the barrel 1 around the axis. In this state, when the protrusion 5*b* of the sleeve 5 enters from a tip end side of the guide groove 6*m* of the joint 6, the sleeve 5 is movable in the axial direction relative to the joint 6 and is rotatable relative to the joint 6 around the axis.

In this state, the bottle 2 in which the rear end portion is closed by the tail plug 9 is internally inserted into the barrel 1 from a tip end side of the bottle 2, a front side of the male screw 2*b* of the bottle 2 is internally inserted into the inter mediate portion 6*b* of the joint 6, the male screw 2*b* of the bottle 2 is screwed into the female screw 1*e* of the barrel 1, and a tip end surface of the large diameter cylindrical portion 2*a* of the bottle 2 abuts against a rear end surface of the barrel 1, so that the bottle 2 is detachably attached to the barrel 1. That is, the barrel 1 and the bottle 2 are integrated with each other, and the joint 6 is immovable relative to the barrel 1 and the bottle 2 in the axial direction and is rotatable relative to the barrel 1 and the bottle 2 around the axis in conjunction with a sliding operation of the sleeve 5 in the axial direction.

Figure 9:
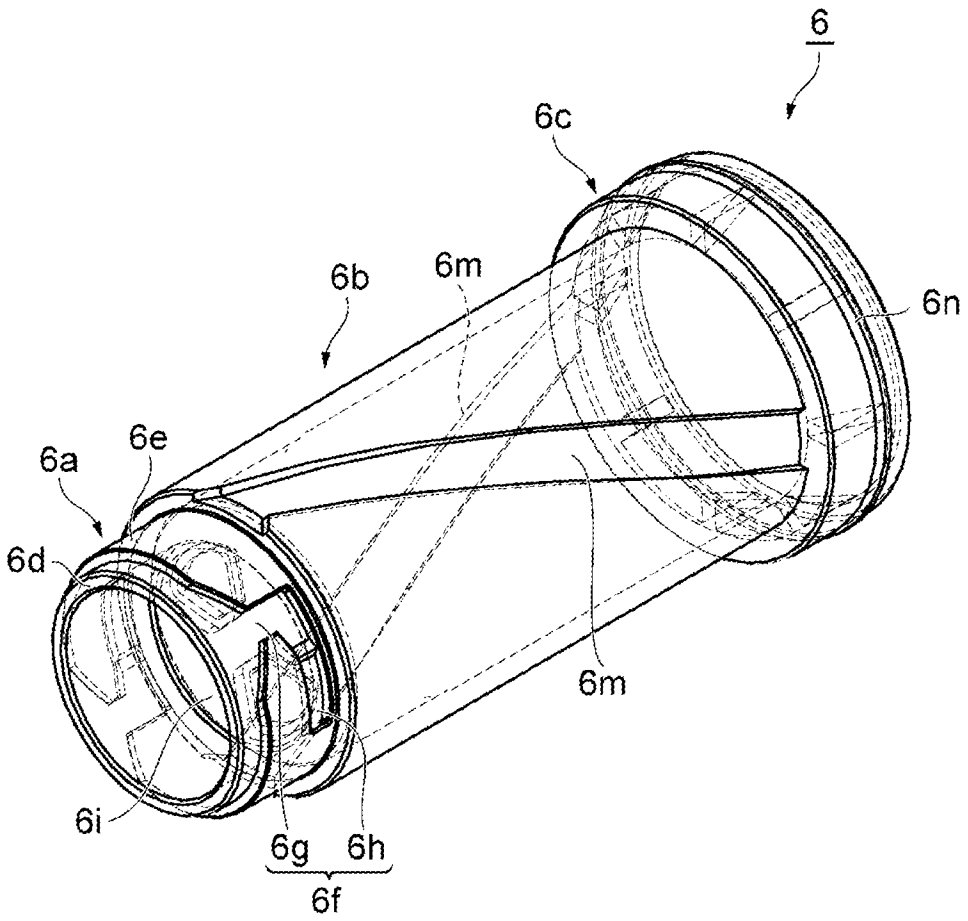
FIG. 9 is a perspective view showing a joint in FIG. 3.
Figure 10:
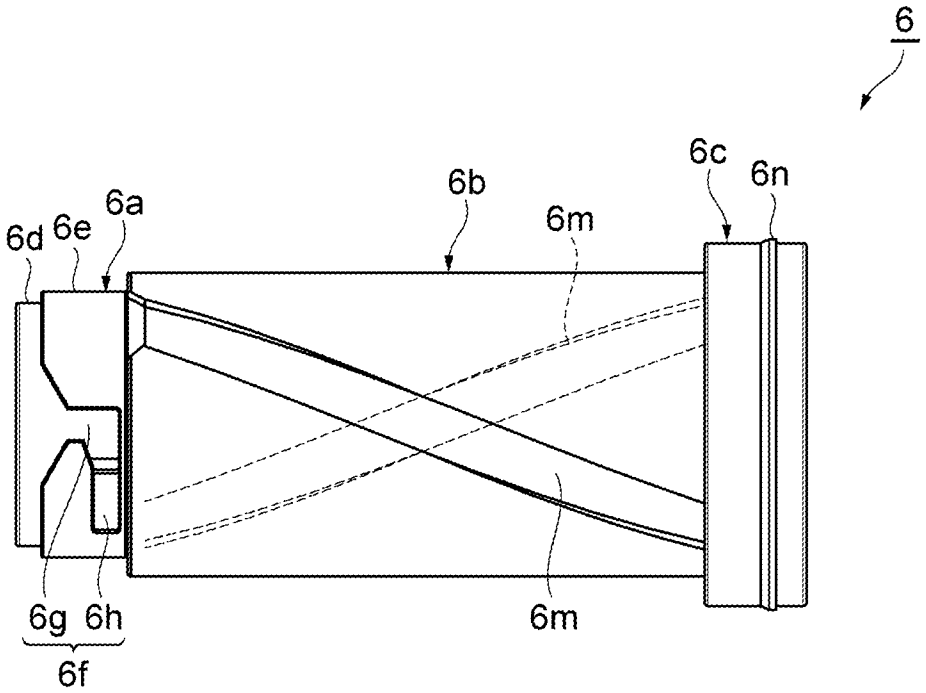
FIG. 10 is a side view of the joint shown in FIG. 9.
Figure 11:
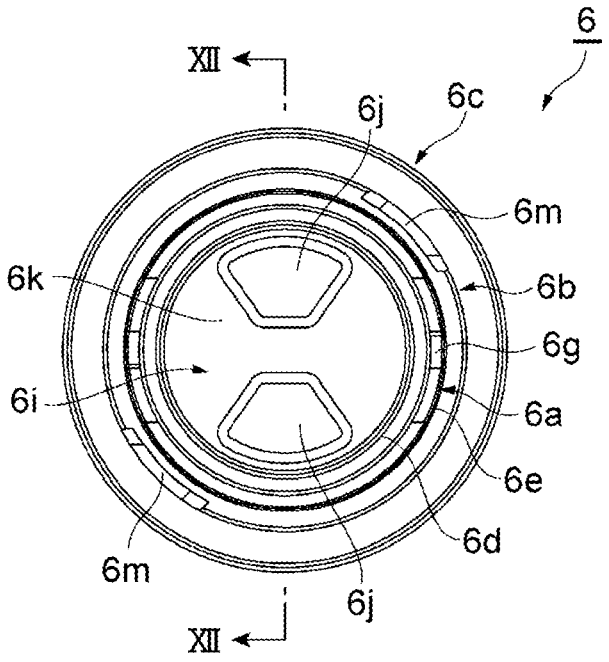
FIG. 11 is a left side view of the joint shown in FIG. 10.
Figure 12:
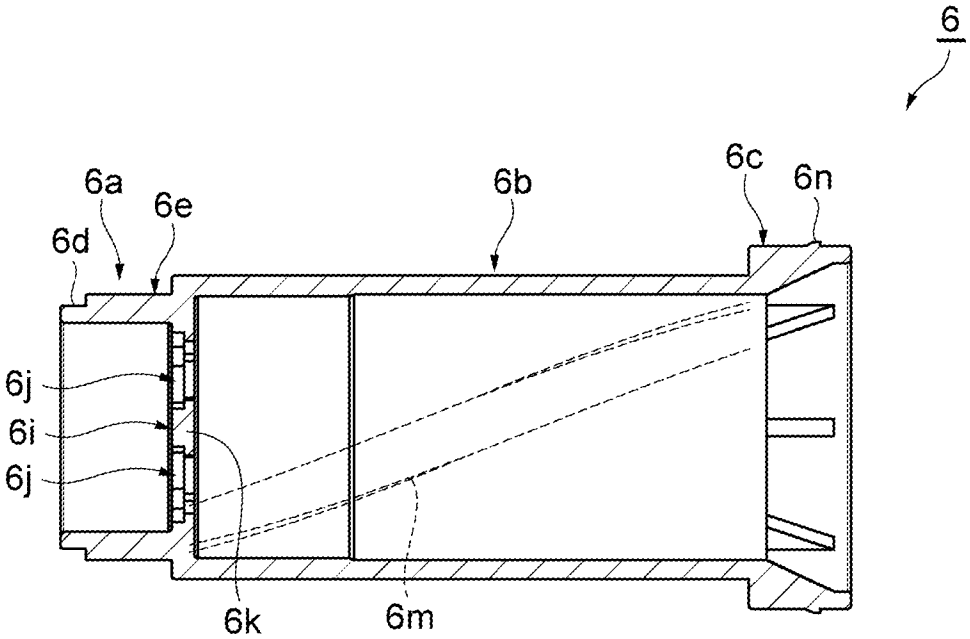
FIG. 12 is a cross-sectional view taken along a line XII-XII in FIG. 11.

The core 4 is externally inserted from a rear end side of the outer cylinder 4*a* to the tip end portion 6*a* of the joint 6, and as shown in FIGS. 9 and 10, the convex portion 4*f* (see FIG. 17) of the core 4 enters the one side 6*g* of the L shaped concave groove 6*f* of the joint 6, the core 4 is rotated, and then the convex portion 4*f* of the core 4 enters the other side 6*h* of the concave groove 6*f* and engages with the other side 6*h* in the axial direction, so that the core 4 is detachably attached to the joint 6. When the core 4 is detached, the core 4 may be rotated in an opposite direction and pulled out toward a front side in the axial direction.

The adjustment portion 7 is, for example, a sponge, and is formed in a short columnar shape as shown in FIGS. 1 and 18. As shown in FIG. 1, the adjustment portion 7 is disposed between the brush 3 and the partition portion 6*i* of the joint 6. More specifically, as shown in FIG. 18, the adjustment portion 7 is disposed inside the cylindrical portion 4*e* of the core 4, and as shown in FIGS. 1 and 2, is disposed between the partition portion 4*c* of the core 4 and the opening portion 6*j* and the closed portion 6*k* of the partition portion 6*i* of the joint 6, and adjusts the amount of the powder P from the joint 6 to the brush 3.

The cap 8 is made of PP or the like, for example, and is formed in a capped cylindrical shape as shown in FIGS. 1 and 3. As shown in FIG. 1, a concave portion 8*a* that engages with the convex portion 1*b* of the barrel 1 in the axial direction is provided in an annular shape on an inner circumferential surface of a rear end portion of the cap 8, and the concave portion 8*a* of the cap 8 is engaged or disengaged with the convex portion 1*b* of the barrel 1, so that the cap 8 is detachably attached to the barrel 1.

According to the cosmetic container with an application member 100 having such a configuration, when the cosmetic container with an application member 100 is not used, for example, when the cosmetic container with an application member 100 is carried, as shown in FIG. 1, the sleeve 5 slides relative to the barrel 1 and is pulled out of the barrel 1 so as to cover the outer circumference of the brush 3, and the convex portion 5*a* of the sleeve 5 is positioned at the advance limit at which the convex portion 5*a* abuts against the tip end surface of the concave portion 1*c* of the barrel 1.

In this state, the opening portion 6*j* of the partition portion 6*i* of the joint 6 is at a position deviated by 90° in the circumferential direction relative to the opening 2*g* of the capped portion 2*f* of the bottle 2, and the closed portion 6*k* of the joint 6 overlaps with the opening 2*g* of the bottle 2, so that the powder P in the bottle 2 cannot pass (leak out) through the opening 2*g*.

In addition, in this state, since the sleeve 5 is pulled out and covers the outer circumference of the brush 3, the cap 8 is easily attached even when the brush 3 has the shape that is gradually swells in the radial direction toward the tip end at the time of use shown in FIG. 2.

On the other hand, when the cosmetic container with an application member 100 is used, as shown in FIG. 2, the cap 8 is detached, and the sleeve 5 slides relative to the barrel 1 and is pushed into the barrel 1 so as to expose the brush 3. Then, while the protrusion 5*b* of the sleeve 5 is guided by the guide groove 6*m* (see FIGS. 9 and 10) of the joint 6, the sleeve 5 and the joint 6 rotate relative to each other by 90°, and the convex portion 5*a* of the sleeve 5 is positioned at the retreat limit at which the convex portion 5*a* abuts against the tip end surface of the rear end portion 6*c* of the joint 6.

In this state, the opening portion 6*j* of the joint 6 overlaps with the opening 2*g* of the bottle 2, the powder P in the bottle 2 passes through the opening 2*g* and the opening portion 6*j* toward the brush 3, and is applied for coating by the exposed brush 3.

That is, according to the cosmetic container with an application member of the present embodiment, it is possible to prevent the powder P from leaking (moving) to the brush 3, when not intended by a user.

According to the present embodiment, since the adjustment portion 7 that adjusts the amount of the powder P is provided between the opening portion 6*j* and the closed portion 6*k* of the joint 6 and the brush 3, excessive discharge of the powder P to the brush 3 is prevented, and an appropriate amount of the powder P is applied.

According to the present embodiment, since the bottle 2 is detachably attached to the barrel 1, for example, when the powder P is used up, the bottle 2 is easily replaced with a new bottle accommodating the powder P.

According to the present embodiment, since the core 4 is detachably attached to the joint 6, for example, when the brush 3 is deteriorated, the core 4 is easily replaced with a new core holding a new brush.

According to the present embodiment, at the time of attaching and detaching the core 4, since the knurl 4*h* as the slip stopper on the outer circumferential surface of the tip end portion of the outer cylinder 4*a* of the core 4 is pinched, attaching and detaching operations of the core 4 is easy.

According to the present embodiment, when the sleeve 5 is pulled out or pushed in, since it is possible to pinch the concave and convex portion 5*c* as the slip stopper on the outer circumferential surface of the tip end portion of the sleeve 5, it is easy to perform operations of pulling out and pushing in.

According to the present embodiment, since the bottle 2 is attached to and detached from the barrel 1 with a screw mechanism, it is possible to reduce a possibility that the bottle 2 is detached from the barrel 1, for example, when the bottle 2 is carried, as compared with a mechanism in which the bottle 2 is attached to and detached from the barrel 1 by being pushed in or pulled out.

In the present embodiment, in the case of exerting the valve function that allows or disables the powder P in the bottle 2 to flow toward the brush 3, by the sliding operation of the sleeve 5, the opening portion 6*j* of the joint 6 and the opening 2*g* of the bottle 2 are overlapped with each other by rotation to allow the powder P in the bottle 2 to pass through the opening 2*g*, while the closed portion 6*k* of the joint 6 and the opening 2*g* of the bottle 2 are overlapped with each other by rotation to prevent the powder P in the bottle 2 from passing through the opening 2*g*. The refill (replaceable) bottle 2 is replaceable with a new bottle accommodating the powder P by a rotation operation of the bottle 2. Here, when a configuration in which the above valve function is exerted by a rotation operation by the screw mechanism is adopted instead of the sliding operation of the sleeve 5, the screwing mechanism is present at two positions, and when the cosmetic container with an application member 100 is used, there is a possibility that an erroneous rotation operation is performed on the bottle 2, the bottle 2 is detached from the barrel 1, and the powder P comes out, but in the present embodiment, since the sliding operation is performed at the time of coating and the rotation operation is performed at the time of replacing the bottle 2, it is possible to reliably prevent an erroneous operation.

Although the present disclosure is specifically described based on the embodiment, the present disclosure is not limited to the above embodiment, and for example, in the above embodiment, the number of openings 2*g* and the number of opening portions 6*j* is two, but may be one, or may be three or more by changing a size of the opening 2*g* and the opening portion 6*j*. When the joint 6 is rotated by, for example, 45°, the number of openings may be four.

In the above embodiment, attachment and detachment of the bottle 2 to and from the barrel 1 is particularly preferably performed by the screws, but it is not necessarily limited to the screws, and may be performed, for example, by fitting or the like.

In the above embodiment, the guide groove 6*m* is particularly preferably provided in the joint 6, and the protrusion 5*b* guided by the guide groove 6*m* is particularly preferably provided in the sleeve 5, but in contrast, the joint 6 may be provided with a protrusion, and the sleeve 5 may be provided with a guide groove.

In the above embodiment, an outer shape of the barrel 1, the tail plug 9, the cap 8 is particularly preferably circular, but various shapes including a square shape, a flat shape, and an elliptical shape may be appropriately adopted.

In the above embodiment, the adjustment portion 7 that adjusts the amount of the powder P is particularly preferably a sponge, but the adjustment portion 7 may be another porous material other than the sponge. In addition, for example, a porous material may not be adopted, and a core 14 shown in FIG. 19 may be used instead of the core 4. In the core 14, a conical portion 13*a* that has a hollow, substantially conical shape protruding rearward is provided at a sponge attachment position, an internal space of the conical portion 13*a* communicates with the inside of the inner cylinder 4*b*, and a plurality of slits 13*b* that communicates the internal space of the conical portion 13*a* with the outside are formed along the circumferential direction on a circumferential surface of the conical portion 13*a*. Even when the core 14 that includes the conical portion 13*a* and the slit 13*b* as an adjustment portion 13 is used, excessive discharge of the powder P to the brush 3 is prevented, and an appropriate amount of the powder P is applied, as in the case of using the adjustment portion 7 made of the porous material such as the sponge.

In the above embodiment, the application member is particularly preferably the brush 3, but may be a comb, a tip, a puff, or the like.

In the above embodiment, the cosmetic is particularly preferably the powder P, but the powder cosmetic other than the powder may be used, and a liquid cosmetic, a gel cosmetic, or the like may be used.

What is claimed is:

1. A cosmetic container with an application member comprising:

a cylindrical barrel as a container body;

the application member configured to apply a cosmetic to a given portion;

a core that holds the application member;

a bottle that is configured to accommodate the cosmetic, has an opening that allows the cosmetic to pass through at a tip end side of the bottle, and is attached to the barrel;

a sleeve that is configured to slide in an axial direction of the barrel relative to the barrel; and a joint that is configured to engage with the bottle so as to be immovable in the axial direction relative to the bottle and rotatable relative to the bottle around an axis in conjunction with a sliding operation of the sleeve relative to the barrel and has an opening portion and a closed portion on a tip end side of the joint, and is attached to the core at a front side of the joint than the opening portion and the closed portion in the axial direction, wherein the sleeve is configured to expose the application member or cover an outer circumference of the application member by the sliding operation of the sleeve, when the sleeve slides in a direction of exposing the application member, the opening portion of the joint overlaps with the opening of the bottle in the axial direction so that the cosmetic passes through the opening portion and the opening, and when the sleeve slides in a direction of covering the outer circumference of the application member, the closed portion of the joint overlaps with the opening of the bottle to prevent the cosmetic from passing through between the joint and the bottle.

2. The cosmetic container with the application member according to claim 1 further comprising an adjustment portion that is provided between the application member and at least one of the opening portion or the closed portion of the joint, and configured to adjust an amount of the cosmetic passing through the opening portion and the opening.

3. The cosmetic container with the application member according to claim 2, wherein the adjustment portion is made of porous material.

4. The cosmetic container with the application member according to claim 1, wherein the bottle is detachably attached to the barrel.

5. The cosmetic container with the application member according to claim 4, wherein the bottle is detached from and attached to the barrel by a rotating operation of the bottle.

6. The cosmetic container with the application member according to claim 4, wherein the core is detachably attached to the joint.

7. The cosmetic container with the application member according to claim 1, wherein the core is detachably attached to the joint.

* * * * *